US008939505B1

(12) United States Patent
Dreyer

(10) Patent No.: US 8,939,505 B1
(45) Date of Patent: Jan. 27, 2015

(54) ADJUSTABLE PORTABLE BOOSTER CUSHION FOR ADULTS

(71) Applicant: Ann B. Dreyer, Fair Play, SC (US)

(72) Inventor: Ann B. Dreyer, Fair Play, SC (US)

( * ) Notice: Subject to any disclaimer, the term of this patent is extended or adjusted under 35 U.S.C. 154(b) by 0 days.

(21) Appl. No.: 13/692,662

(22) Filed: Dec. 3, 2012

Related U.S. Application Data

(60) Provisional application No. 61/565,791, filed on Dec. 1, 2011.

(51) Int. Cl.
*A47C 7/00* (2006.01)
*A47C 16/00* (2006.01)
*A47C 7/62* (2006.01)

(52) U.S. Cl.
CPC ..... *A47C 7/62* (2013.01)
USPC ..... 297/219.1; 5/653

(58) Field of Classification Search
USPC ..... 297/219.1, 230.12, 382, 4, 452.37, 297/452.27, 255; 5/728, 653
See application file for complete search history.

(56) References Cited

U.S. PATENT DOCUMENTS

| | | | | | |
|---|---|---|---|---|---|
| 2,577,949 | A | * | 12/1951 | Barrett | 297/382 |
| 3,032,916 | A | * | 5/1962 | Oakes | 108/41 |
| 3,222,694 | A | * | 12/1965 | Schick | 5/653 |
| D258,482 | S | * | 3/1981 | Strock | D6/596 |
| 4,597,605 | A | * | 7/1986 | Gilbert | 297/228.1 |
| 4,822,309 | A | * | 4/1989 | Vandenberg | 441/35 |
| 4,887,865 | A | * | 12/1989 | Dawidzon | 297/382 |
| 4,925,241 | A | * | 5/1990 | Geraci | 297/229 |
| 5,016,303 | A | * | 5/1991 | Tanaka et al. | 5/636 |
| D366,800 | S | * | 2/1996 | Moore, Jr. | D6/601 |
| 8,534,755 | B2 | * | 9/2013 | Nickerson | 297/219.1 |

* cited by examiner

*Primary Examiner* — Milton Nelson, Jr.
(74) *Attorney, Agent, or Firm* — Clinton H. Wilkinson; Charles A. Wilkinson

(57) ABSTRACT

An adult booster seat in the form of two cushions connected by a folding panel to allow use on a seating surface alternatively with either one or both under a seated adult. The second cushion serves as a back support when rotated away from use upon a seat.

8 Claims, 4 Drawing Sheets

ADJUSTABLE PORTABLE BOOSTER CUSHION FOR ADULTS

BACKGROUND OF THE INVENTION

Field of the Invention

The present invention is directed to so-called booster seats and cushions for use particularly by adults to adjust the height of a seat to a proper or comfortable sitting height, and more particularly to a booster seat or cushion that is preferably adjustable to at least two different heights, is easily carried, and is suitable for use in a variety of public and private environments such as in restaurants, theatres, stadiums, at work as well as at home while seated at a desk or dining table, or in an automobile.

Public seating such as a chair at a restaurant or a booth at a diner is typically positioned at a standard height with respect to a table. While such standard accommodations are likely comfortable and appropriate for persons who are of average height or size, often the seat height in relation to the table is too low for shorter than average persons. For persons having smaller or shorter frames, the table top will often be positioned too high with respect to the seat, resulting in the torso of such person being too low in relation to the table top for comfortable dining, since such person's arms by necessity would have be continually raised beyond what is normally considered a uncomfortable eating or dining position. Where a person is very petite or small, the seat back may also be positioned uncomfortably far away so that such person has no back support unless they lean backward beyond a substantially vertical torso position. In still other cases, while a diner booth seat cushion or other seating may have been positioned at a proper height in relation to a table for the average person when new, over time the cushions become compressed and lose their elasticity or may be sagging, and as a result a depressed area may develop in the cushion causing the user to "sink" farther into the seat, so that even the average sized person at an uncomfortable height.

Provision of booster chairs and seats for children is quite common. However, there is a dearth of products available designed to be used by adults to adjust the height of a public seat or booth. While at home, one might place a simple cushion or pillow under the buttocks on a seat to raise the seat height. However, such items are often not available in a restaurant or other public area, or may be of questionable cleanliness due to repeated use by different patrons and not being wiped or cleaned properly. Furthermore, only an unusually uninhibited person is likely to feel comfortable carrying a personal pillow or cushion from home to a restaurant or the like, unless it is somehow attractive or specially designed for such purpose, or is required for medical purposes.

In addition, each patron or customer at a restaurant or the like will have different requirements for a properly adjusted seat height depending on their shape and size as well as the particular seating environment. Therefore, provision of a single height cushion although likely helpful to some extent would not suffice. Providing special booster or adjustable height chairs for adults is also not a practical solution, not only because such chairs would be a significant additional expense, but also unless it did not have the appearance of being a booster chair many adults would likely choose not to use such a chair in any event due to vanity considerations, as this would only accentuate their short stature. There has, therefore, been a long felt need for a portable booster cushion designed for use by adults that can be readily customized for use by persons of different sizes or having different height requirements, and furthermore which when carried is unobtrusive or does not draw attention to the person.

The following references are illustrative of the state of the art.

U.S. Pat. No. 1,776,983 issued to B. Rotherham on Sep. 20, 1930, entitled "Combined Seat Cushion, Foot Muff, and Carrier or Receptacle," discloses a seat or back cushion having a handle and an interior compartment with a zipper opening on one side, which compartment is lined with a soft material, and can be used as a foot muff, storage compartment, or purse.

U.S. Pat. No. 2,108,242 issued to L. Wallace on Feb. 15, 1938, entitled "Adjustable Cushion," discloses a cushion for a piano bench, primarily for use by children, having a fabric cover with an interior compartment that is closed by a drawstring arrangement. A plurality of inserts designed to be placed in the cover are provided, wherein the top insert is made of a cushion material such as foam rubber, and the lower inserts are made of a more solid sheet material such as pressed wood or particle board. In one embodiment six inserts or leaves are provided, having different thicknesses, so that the height of the seat cushion can be adjusted by inserting the appropriate number of leaves in the cover.

U.S. Pat. No. 2,498,113 issued to E. E. Milner on Feb. 21, 1950, entitled "Motorboat Equipment", discloses a seat cushion comprised of two pads joined by a hem (24) and having a carrying strap that also doubles as a tote for carrying an outboard motor.

U.S. Pat. No. 4,096,929 issued to N. R. Frey et al. on Jun. 27, 1978, entitled "Multipurpose Bag", discloses a bag comprised of two bag sections releasably joined by a zipper, with an interior compartment and a handle or carrying strap. At least one of the bag sections is padded so it can be separated and used as a seat cushion, while the other may contain a stiff layer of cardboard material or the like and include a chamber for carrying articles.

U.S. Pat. No. 4,836,605 issued to M. N. Greenwood et al. on Jun. 6, 1989, entitled "Inflatable Booster Seat," discloses an inflatable children's booster seat having a lower portion (12) and an upper portion (14), wherein the lower portion has a generally donut-shaped inflatable section with a flexible cover, and the upper portion has a U-shape to serve as a backrest or support for the seat. Greenwood is exemplary of the numerous inflatable seats and seat cushions known and commercially available in the prior art, as are various hard plastic booster seats, most of which are primarily designed for use by children.

U.S. Pat. No. 4,945,589 issued to A. R. Carey on Aug. 7, 1990, entitled "Combination Seat Cushion and Carrying Bag", discloses a seat cushion having two opposed side panels containing a padded insert, and carrying pockets with inner sleeves or a zipper pocket between such panels. Carey indicates that the padded side panels in addition to serving as seat cushions protect the contents of the bag so they do not have to be removed when the device is used as a cushion.

U.S. Pat. No. 5,190,344 issued to R. Anderson et al. on March, 1993, entitled "Single Mold Stadium Seat", discloses a seat comprised of a pair of hinged seat members, shown in FIG. 1 having seat cushions of a type such as shown in FIGS. 9 and 10 attached. The seat cushions have pockets on one side for receiving the rigid seat members.

U.S. Pat. No. 5,191,665 issued to M. E. Breedlove on Mar. 9, 1993, entitled "Inflatable Cushion", discloses a cushion having an inflatable annular tube, a center pocket in which a heating unit (42—see FIG. 2) or pad may be inserted, and a carrying strap.

U.S. Pat. No. 5,333,336 issued to R. L. Langsam on Aug. 2, 1994, entitled "Inflatable Booster Seat", discloses another inflatable booster seat having two inflatable chambers, which apparently strengthens the seat. Although designed for children, such seat could also be carried or used by shorter adults.

U.S. Pat. No. 5,475,886 issued to J. Mintz on Dec. 19, 1995, entitled "Combination Pillow and Chair Cushion with Tie String Accommodating Pocket," discloses a pillow or cushion having strings for tying the cushion to a chair, and also a pocket for storing the strings so that the cushion can also be used as a decorative pillow.

U.S. Pat. No. 5,820,209 issued to T. O. Weber on Oct. 13, 1998, entitled "Adjustable Height Seating Support," discloses a foam-filled seat cushion primarily for children with spinal defects having generally a C-shape with an arrow shaped center aperture, as well as a carrying handle. The center portion of the cushion is wider than the end sections, which forces one using the seat to sit up and keep their back straighter, improving sitting posture. The handle can be used in combination with the seat section to adjust the height of the cushion.

U.S. Pat. No. 6,109,686 issued to A. B. Fox on Aug. 29, 2000, entitled "Chair for Use by an Adult or a Child," discloses an office or desk chair having a pivoting seat cushion, so that when the cushion is rotated upwardly it serves as the back for the child seat.

U.S. Pat. No. 6,905,169 issued to R. J. Donoghue on Jun. 14, 2005, entitled "Triangular Child's Booster Seat," discloses a triangular booster seat that is five inches in height with 12 inch long sides, and is made of polyfoam with a cover over it. The seat includes string fasteners for tying the cushion to a chair, and a safety strap which is placed around a child sitting on the booster seat.

U.S. Design Pat. No. 348,783 issued to C. L. Young on Jul. 19, 1994, entitled "Booster Seat", discloses a booster seat having a generally rectangular shape and carrying straps on both ends which are brought together when the seat is folded and carried. FIG. 2 appears to illustrate a hem on one side to facilitate folding.

U.S. Design Pat. No. D356,705 issued to J. Aston on Mar. 28, 1995, entitled "Seat Cushion," discloses an ornamental design for a seat cushion having a generally triangular flat shape or half diamond shape, and including a zipper on its long side edge and a wrist strap.

U.S. Pat. Pub. No. 2002/0167214 issued to E. Nelson et al. on Nov. 14, 2002, entitled "Booster Seat," discloses a portable booster seat for a child having a back support section, a buckle, which can also be folded into a compact configuration for carrying and storage, or may be used as a carrying bag.

U.S. Pat. Pub. No. 2007/0046084 issued to J. S. Leach on Mar. 1, 2007, entitled "Non-Slip Body-Conforming Booster Cushion Seat," discloses a booster seat cushion having a square bottom, trapezoidal shaped sides, and a somewhat depressed top surface on which a user sits. The cushion also includes a strap for securing around the back of a chair, and a waist belt, with the novelty of the device apparently claimed to be in the body-conforming, malleable material, and the non-slip, textured surface provided.

U.S. Pat. Pub. No. 2007/0221800 issued to A. Levin on Sep. 27, 2007, entitled "Portable Device and Method for Raising the Height of Furniture," discloses an alternative arrangement for raising the height of a seat, wherein rather than placing a cushion or booster seat on the chair of seat, a device is provided having four pedestals on which the lower ends of the legs of a chair are inserted, so that the height of the entire chair is raised a few inches.

While the above-summarized references may be suitable for their particular intended purposes, none of such height adjusting cushions or arrangement fulfills all of the requirements met by the booster cushion of the present invention.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
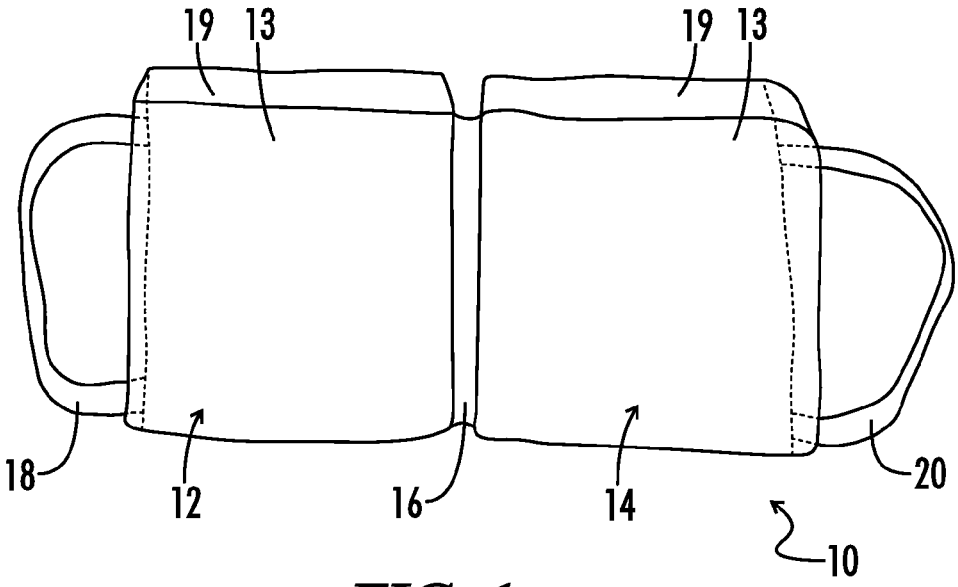
FIG. 1 is an isometric view of a preferred embodiment of the booster seat cushion of the present invention from the top in an unfolded configuration.

FIG. 1 is an isometric view of a first preferred embodiment of the adult booster seat cushion device of the present invention. Cushion device 10 is comprised of generally similarly shaped first and second seat sections 12 and 14 each having inner 13, outer 15, side 19, and end 21 panels joined together by sewing or the like so as to be capable of holding or containing a padded member. Seat sections 12 and 14 are preferably generally substantially square or rectangular in shape, and are dimensioned to accommodate the entire buttocks of an average sized adult user when seated on the one of such panels deployed in various configurations, as will be explained in greater detail below. It will be understood, however, that seat sections 12 and 14 may be provided in different sizes and shapes according to the required specifications and particular desired design considerations as long as they are dimensioned to fulfill their intended use requirements.

Figure 2:
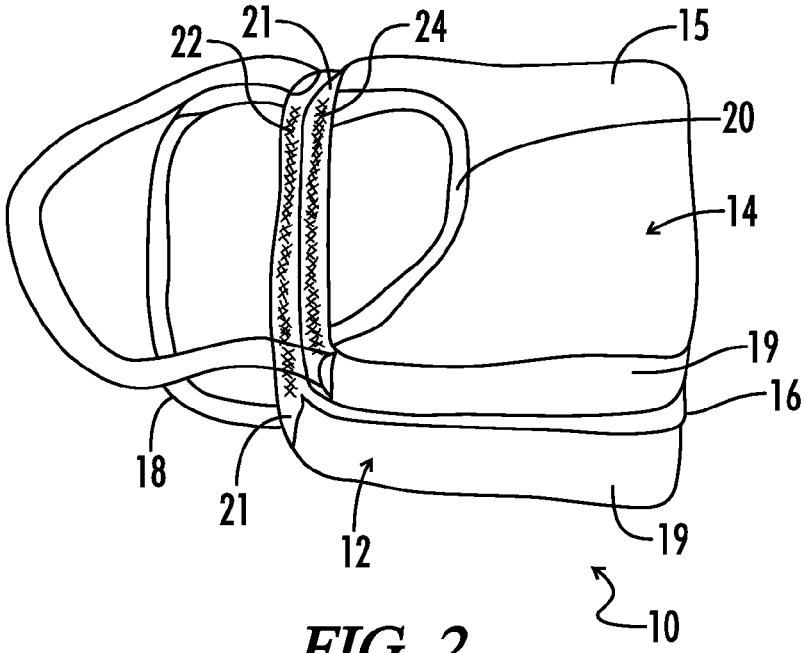
FIG. 2 is an isometric view thereof in a folded configuration.

First and second seat sections 12 and 14 are joined along a common edge of the inner panels 13 adjacent a pair of end panels 21 by a flexible narrow hem or connecting strip 16, which preferably extends along the entirety of such inner panel edge and is connected between the sections by sewing or other suitable means. In addition, flexible handles or straps 18 and 20 are attached preferably also by sewing to first and second seat sections 12 and 14, respectively, along the side edge of the outer panels 15 adjacent end panels 21 opposite flexible connecting member 16. As shown in FIG. 2, first and second seat sections 12 and 14 each preferably include a zipper 22 and 24 on end panels 21 which opens to a pocket comprising the space between the panels and into which one or more padded cushion members are inserted and secured. The panels of first and second sections 12 and 14 are preferably formed from a soft flexible material such as vinyl, leather, or any other suitable material that will be evident to those skilled in the art as being compatible for use as seat cushions in a public venue. Flexible connecting member 16 may be formed of the same flexible materials as the panels forming first and second seat sections 12 and 14, while handles 18 and 20 may also be made of the same flexible material but preferably are made of a sturdy flexible woven cord material of a type also known to those skilled in the art.

As indicated above, flexible hem or connecting member 16 is secured to first and second seat sections 12 and 14 along a common side edge of the inner panels 13, which when cushion 10 is disposed in the folded configuration shown in FIG. 2 are in abutting contact with one another. Such positioning of connecting member 16 as is evident from the drawings allows cushion 10 to be either laid flat with first and second seat sections 12 and 14 positioned side by side as shown in FIG. 1, or in a folded configuration with second seat section 14 opposed with first seat section 12 as shown in FIG. 2. Flexible handles or straps 18 and 20 are preferably secured to the edges of the outer or outwardly disposed panels 15 along the edge opposite hem 16. Such arrangement, as shown in FIG. 2, places the straps along the outwardly facing edges of first and second seat sections 12 and 14 when cushion 10 is folded, which facilitates manually carrying of booster cushion device 10 via such straps while continually urging or holding first and second seat sections 12 and 14 to remain in a folded configuration when the straps are brought together in the hand of the carrier.

Figure 3:
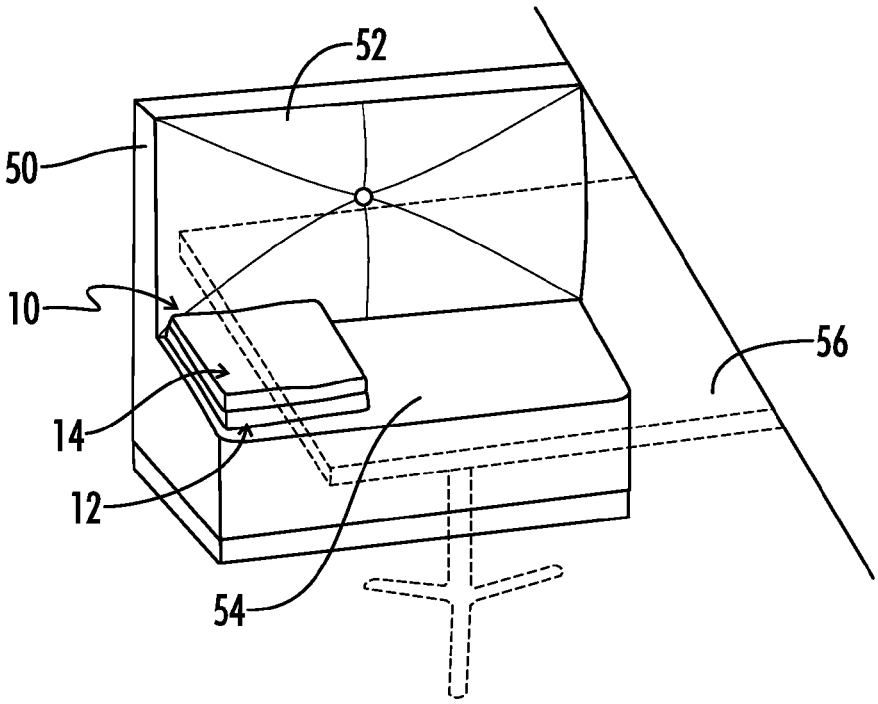
FIG. 3 illustrates a first mode of use of the adult booster cushion device of the present invention.

The basic manner of use and features of adult booster cushion 10 will now be described with particular reference to FIGS. 3 and 4. FIG. 3 illustrates a typical restaurant booth with a seat 50 having a generally vertical back section 52 and horizontal seat section 54, and a table 56, shown in dotted lines for purposes of illustrating the invention, positioned in front of booth 50. Such booths will typically include another seat on the opposite side of table 56, which seat has also been omitted for purposes of illustration of the use of booster cushion device 10. In FIG. 3, cushion 10 is in the folded configuration discussed above with respect to FIG. 2, and is resting on seat section 54 with one side edge in close proximity to the back section 52 of seat 50. The folded configuration provides a maximum temporary boost or increase in the vertical height of the sitting position on seat section 54. In a preferred embodiment, first and second seat sections 12 and 14 will each have a width from exterior to interior side of about two inches, so that when folded the width of booster cushion device 10 will be approximately four inches.

Figure 4:
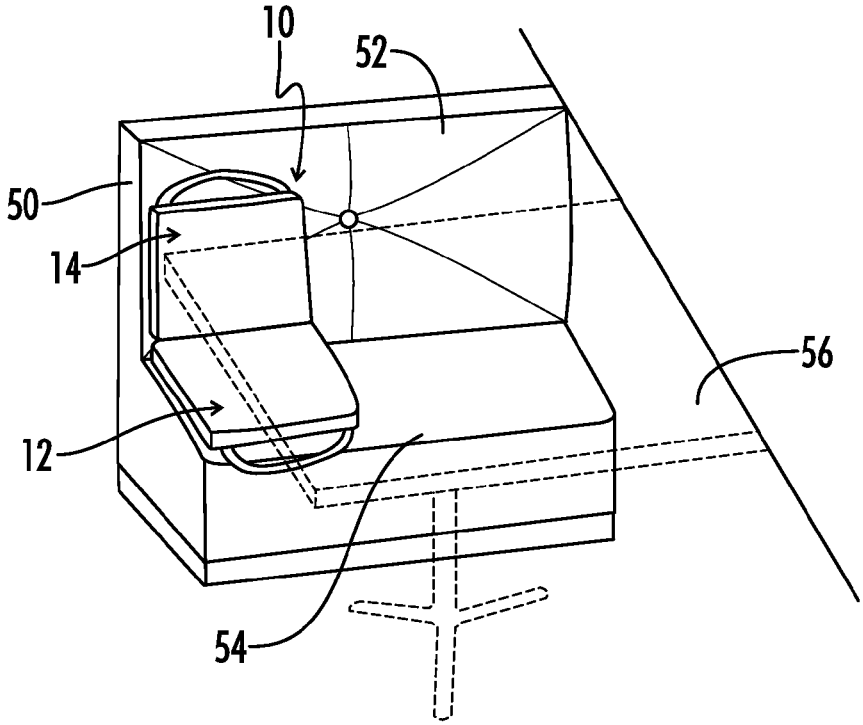
FIG. 4 illustrates a second mode of use of the adult booster cushion device of the present invention.

In FIG. 4, the restaurant booth with seat 50 and table 56 is again shown, this time, however, cushion device 10 is in a partially unfolded configuration with first section 12 supported on seat 54 and second section 52 against in a vertical position resting against seat back 52. When cushion device 10 is oriented as shown in FIG. 4, the user will only be sitting on the inner panel 13 of second section 14 of cushion 10, having a width of two inches, and therefore the boost in vertical height provided will only be half as much as shown in FIG. 3. In addition, however, first section 12 will provide additional back support for the user, particularly if he or she has a smaller frame and the seat back 52 is spaced too far away from the user's back when seated, which is often the case with respect to persons needing a booster seat in the first place. Thus, the distance between seat back 52 and the user's back is reduced by two inches, which in many cases is sufficient for the user's back to be better supported by seat back 52.

The adult booster cushion 10 of the present invention is thus designed to be placed on a chair, elongated seat, or the like, to increase the height of the seat to a more desired height. There is a substantial need for such an invention, particularly in restaurants, where the dining booth seats in many cases are too low for shorter or smaller individuals, and the table is too high or otherwise at an uncomfortable level for dining, even sometimes for the average sized diner. The booster cushion could either be made available to restaurant patrons upon being seated, or could be carried by individuals to the restaurant. Furthermore, in another embodiment, while seat members 12 and 14 are indicated in the embodiment just described as having a total width of about four inches, different sets of booster seat cushions having different widths, such as one having a total width of four inches and another having a total width of six inches, is also within the intended scope of the present invention, which different cushions could be marketed as a group to restaurants to be used by patrons having different booster requirements. In addition, individual seat members 12 and 14 of the same booster cushion 10 could also have different widths, such as seat member 12 having a total width or thickness of about two inches, and seat member 14 having a total width or thickness of about three inches. This would be advantageous in that the booster seat 10 would be more versatile, since the seat members could be oriented for use individually or separately to increase the number of different vertical heights at which the booster cushion 10 could be used from two to three, depending upon whether the user is seated on seat cushion 12, or if the booster seat 10 is reversed so the user is seated on seat cushion 14, or if the booster seat is folded so the user is seated on both seat cushions 12 and 14.

Figure 5:
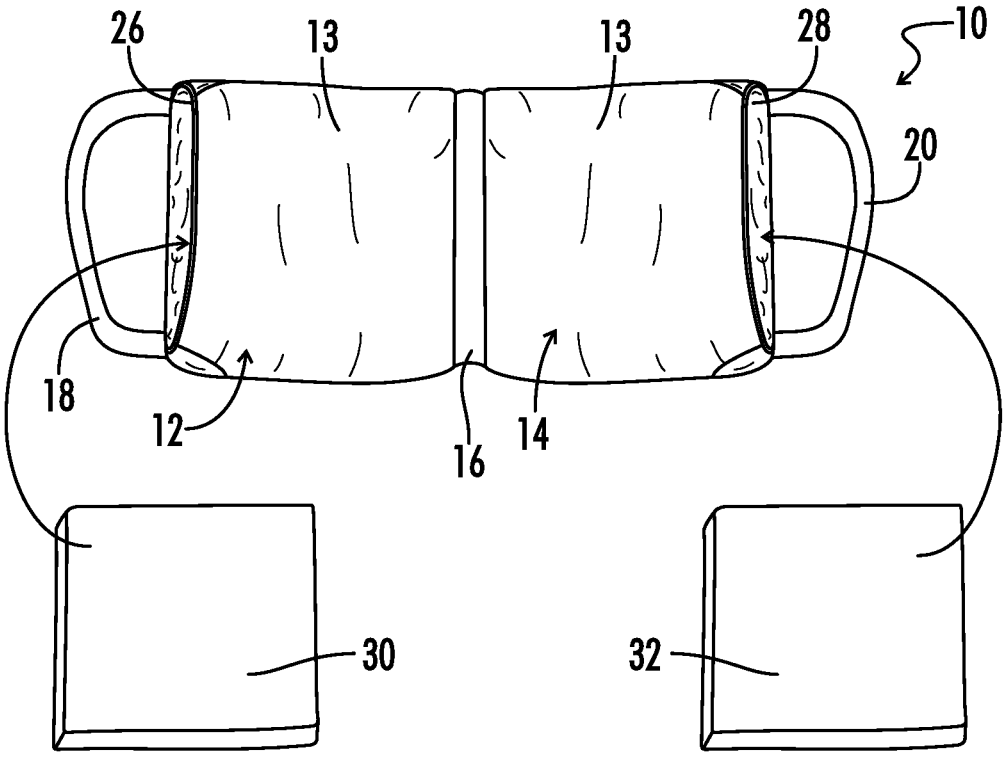
FIG. 5 is an isometric view of another preferred embodiment of the booster cushion of the present invention.
Figure 6:
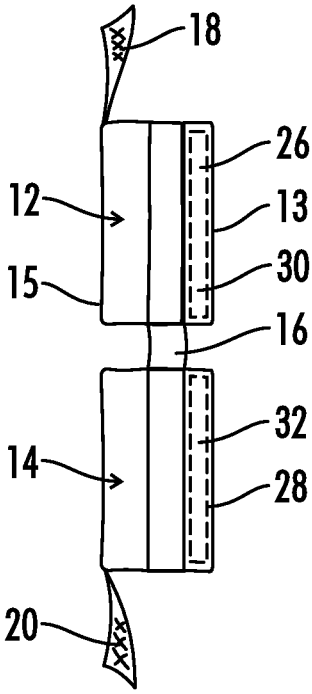
FIG. 6 is a side view of the alternative embodiment of the present invention illustrated in FIG. 5.
Figure 7:
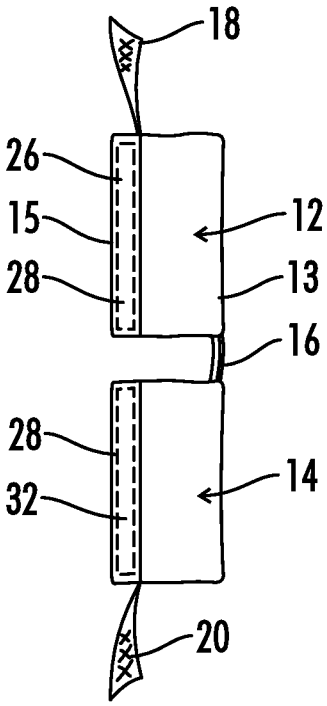
FIG. 7 is a side view of an alternative embodiment of the present invention shown in FIGS. 5-6.

FIGS. 5-7 illustrate a desirable modification of the invention in that one or both seat sections may be provided with an easily closed pocket on the inner or outer surface of the seat section. In FIGS. 5 and 6, an expandable pocket 26 is located on the inner surface 13 of seat section 12 while another expandable pocket 28 is located on the inner surface 13 of seat section 14. In addition, pockets 26 and 28 are each adapted to receive therein a seating height extender 30 and 32, respectively, which is preferably in the form of a stiff sheet of expandable plastic composition, or a cushion material having a greater density than the permanent cushion member. Preferably, seat height extenders 30 and 32 will have a thickness of about one inch, and are shaped and sized similarly to the two seat sections 12 and 14 of adult booster seat 10. The two extenders 30 and 32 add, when combined, an additional height of two full inches to the combined vertical height of four inches of the seat sections 12 and 14, for a combined maximum possible vertical height of a full six inches.

Furthermore, there may be supplied extenders 30 and 32 of different thicknesses, which may be supplied separately or combined with the basic booster seat. For example, a purchaser of a booster seat may purchase extenders 30 and 32 having heights, thicknesses, densities, or materials in accordance with their needs, i.e. ranging in thickness depending upon the needs of the user and if a restaurant or the like is to supply their own booster seats in accordance with the invention to their own customers, such restaurant or the like may keep a selection of extenders of different heights available as required. Extenders 30 and 32 preferably have a smooth outer surface to facilitate easy insertion and removal from pockets 26 and 28, and in addition the corners of extenders 30 and 32 are preferably rounded to make insertion into pockets 26-28 easier without catching on the pocket material.

In the embodiment shown in FIG. 7, pocket 26 and 28 are disposed on the exterior surfaces of cushion or seat sections 12 and 14. For practical purposes this arrangement it is believed will be preferred over the arrangement shown in FIGS. 5 and 6 by most users, since extenders 30 and 32 will now be disposed upon the back or outside surfaces of the cushions 12 and 14. In this way, when in an open configuration as shown, the user of the booster seat of the invention neither sits directly upon nor rests with his or her back directly upon the relatively harder extender 30 or 32 when used, but instead on the more resilient material of the main booster cushion seat sections 12 and 14, while the cover for the extender will be in contact with the seat and back of the seat by which or against which it is supported. Some users, however, may prefer to sit on the harder extender surface, particularly if such user has a spinal defect or injury or needs assistance to sit in an upright position, in which case the booster device 10 could be used in a closed configuration.

The openings for pockets 26 and 28 in seat sections 12 and 14 may be closed by an easily operated closer means, such as a zipper or the more modern hook and loop fasteners sold under the trademark Velcro®. It will be found that the accommodation of pockets for the extenders of various thicknesses' will be more stable if placed on the outside of the booster seat sections. However, as shown in FIG. 5-6 the pockets and extenders may also be placed along the inner surfaces of the seat sections, with, however, somewhat less stability when the full height sections are placed upon each other. When the extender sections are placed on the outside of the extender sections, however, and the full height or elevation is desired, the two flat extenders come together with the two cushions contacting the seat on one side and user on the other sides, and with one edge of the opposed seat sections in contact with the back of the restaurant booth seat or the like on the other side, providing a more stable stacking. When the booster seat is oriented so the user is resting on only a single seat section, the seat will also provide additional support and stability for the user.

Figure 8:
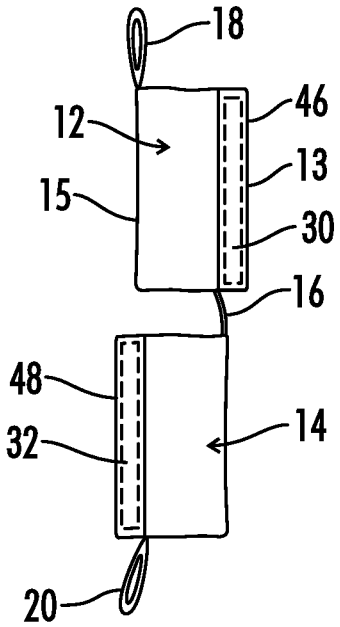
FIG. 8 illustrates another alternative embodiment of the present invention.

FIG. 8 illustrates another alternative embodiment of the present invention, in which the pockets and extenders are placed on alternate sides of the seat cushions 12 and 14. More particularly, pocket 46 holding extender 30 is disposed on the inner surface of seat section 12, while pocket 48 is disposed on the outer surface of seat section 14. This arrangement is preferred because the user has the option of sitting on the softer seat section 14 while the harder surface of extender 30 is adjacent the back of the user, or alternatively the user can sit on the harder support surface of pocket 46 with extender 30, with his or her back against the softer inner surface of seat section 14. Furthermore, in a closed configuration, the user can orient the booster cushion so that either the soft outer surface of seat cushion 12 or the harder outer surface of seat cushion extender 32 is oriented upwardly. In another preferred arrangement, pockets 30 and 32 have different sizes, such that one may accommodate an extender having a width of about two inches and the other accommodates an extender having a width of about three inches. The extenders may also be made of a material such as particle board, and in addition could be used to hold or carry articles such as magazines or newspapers, which could also be used to vary the thickness of the cushions. In addition, other items such as a lightweight raincoat or flexible hat could be carried in the pockets, which may also be marketed and sold in combination with the device, particularly if adapted for use in outdoor or wet environments, or alternatively could be carried merely for precautionary purposes.

It is also contemplated that the cushion material in seat sections 12 and 14 may have different densities. This can vary such that the material in seat section 12 has a different density from the material in seat section 14, or different areas of a single seat cushion may have different densities. For example, the center area of seat cushion 12 on which the buttocks and upper legs are supported could be less dense than the area of the seat cushion around the periphery, which could be somewhat denser, whereby the material of different densities could be inserted in different contoured pockets or sections of the seat.

Additional improvements or features may also be provided. These include but are not limited to an outer case that may be supplied to protect the booster seat from soiling and also to keep it dry when carried in precipitation, wet seats being notoriously uncomfortable to rest upon or sit upon. In addition, ties may be provided on the sides of the seat sections such that when the cushions are opened the back cushion is held at about a ninety degree angle with respect to the seat cushion, thus improving the back support ability of the booster seat. Another improvement, as shown in FIG. 2, a crossover shoulder strap may be provided to aid in carrying booster cushion device 10, which makes device 10 easier to carry for some similar to a conventional computer bag or the like with the device 10 positioned at about hip height.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. An adult booster seat assembly for use with a seating device in commercial eating establishments comprising:

(a) a first booster cushion;

(b) a second booster cushion; said first and second cushions each including inner, outer, side and end panels secured together for containing a cushion member, (c) a flexible connecting section secured between the first and second booster cushions along a common edge of said inner panels, allowing said cushions to take a first use position with one of said cushions supported on a seat portion of said seating device and the other of said cushions extended upwardly against a back portion of said seating device while remaining connected together by said connecting section, and a second use position in which the first and second cushions assume a superimposed position in which the inner panels of each cushion are facing inwardly and are aligned, and the outer panels of each cushion when in said superimposed position are facing outwardly;

(d) a pair of looped handle members attached one to each of said first and second booster cushions in positions such that the handle members can be grasped simultaneously in one hand of a user in order to carry said cushions with the cushions in said superimposed position;

(e) a first expansion pocket disposed along the inner panel of said first booster cushion, and a second expansion pocket disposed along the outer panel of said second booster cushion, said first and second expansion pockets being substantially coextensive with said inner and outer panels; and (f) at least one seat height extender adapted to be received in each of said first and second expansion pockets.

2. An adult booster seat assembly in accordance with claim 1 in which said at least one seat height extender has a greater density than the first and second cushion expander members.

3. A portable booster seat suitable for use by adults in restaurants and other eating establishments providing sit-down dining and being adjustable to different heights comprising:

(a) a pair of flattened flexible cushion members each having an inner side surface and an outer side surface being sized to be received on a generally horizontal seat and to receive the buttocks of one of said adults, each of said pair of flattened cushion members having a different thickness than the other one of said pair of flattened cushion members; and (b) an integral flexible connecting member extending between the pair of flattened cushioned members and permanently connecting said pair of flattened cushion members in a generally pivotal manner with respect to each other, whereby said pair of flattened cushion members can assume at least two relational configurations including direct contact of their surfaces in a mutual supporting relationship and substantially more than a ninety degree extended pivotally apart relationship when not in supportive relationship with each other;

(c) each of said pair of flattened cushion members having an expandable pocket adapted for receiving a seating height extender, said pocket located along the inner side surface of one of said pair of flattened cushion members and along the outer side surface of the other of said pair of flattened cushion members, (d) the expandable pocket of one of said flattened cushion members being dimensioned to receive a seating height extender having a first maximum thickness, and the pocket of the other of said flattened cushion members being dimensioned to receive a seating height extender having a second maximum thickness, said first maximum thickness being greater than said second maximum thickness, and (e) a pair of seating height extenders each dimensioned to be received in at least one of said expandable pockets for increasing the effective thickness of the cushion members.

4. A portable booster seat for use by adults in restaurants and other eating establishments in accordance with claim 3 in which a plurality of said seating height extenders having different thicknesses is provided.

5. A portable booster seat for use by adults in restaurants and other eating establishments in accordance with claim 4 in which said at least one seat height extenders has a greater density than the cushion members.

6. A portable booster seat for use by adults in restaurants and other eating establishments in accordance with claim 4 in which said seating height extenders are comprised of flattened stiffening panels.

7. A portable booster seat for use by adults in restaurants and other eating establishments in accordance with claim 3 in which said seat height extenders have a smooth outer surface.

8. A portable booster seat for use by adults in restaurants and other eating establishments in accordance with claim 7 in which said seat height extenders have rounded corners.

* * * * *